United States Patent [19]

Manning

[11] 3,941,597

[45] Mar. 2, 1976

[54] APPLICATION OF PROTECTIVE POLYMER TO PROCESSED DIFFUSION TRANSFER LIGHT SENSITIVE ELEMENT

[75] Inventor: Monis J. Manning, Lexington, Mass.

[73] Assignee: Polaroid Corporation, Cambridge, Mass.

[22] Filed: Dec. 17, 1973

[21] Appl. No.: 424,923

[52] U.S. Cl. ..... 96/29 R; 96/50 PL

[51] Int. Cl.[2] ..... G03C 5/54; G03C 5/26

[58] Field of Search ..... 96/50 RL, 29 R, 76 R

[56] References Cited

UNITED STATES PATENTS

| | | | |
|---|---|---|---|
| 2,830,900 | 4/1958 | Land et al. | 96/50 PL |
| 3,345,166 | 10/1967 | Land et al. | 96/29 R |
| 3,345,167 | 10/1967 | Green | 96/29 R |
| 3,442,649 | 5/1969 | Rasch et al. | 96/50 PL |
| 3,642,473 | 2/1972 | Johnson | 96/29 R |
| 3,697,277 | 10/1972 | King | 96/50 PL |
| 3,697,278 | 10/1972 | Harris et al. | 96/50 PL |

*Primary Examiner*—David Klein
*Assistant Examiner*—Richard L. Schilling
*Attorney, Agent, or Firm*—Sheldon W. Rothstein; Esther A. H. Hopkins

[57] ABSTRACT

A developed and fixed unwashed negative component of a diffusion transfer photographic film unit is protected and preserved for an extended period.

8 Claims, No Drawings

APPLICATION OF PROTECTIVE POLYMER TO PROCESSED DIFFUSION TRANSFER LIGHT SENSITIVE ELEMENT

BACKGROUND OF THE INVENTION

Photographic processes for forming a silver image by diffusion transfer are well known. Processes for forming a usable negative image along with a positive silver transfer image are also known. In a typical process, a light-sensitive silver halide emulsion which has been exposed to actinic radiation is contacted with an aqueous alkaline processing composition including a silver halide solvent and a silver halide developing agent whereby exposed and developable silver halide is reduced to metallic silver to form a negative image, and substantially contemporaneously an imagewise distribution of a soluble silver complex is formed as a function of unexposed areas of the emulsion. This imagewise distribution is transferred by diffusion to a superposed image-receiving layer where it is reduced to metallic silver to form a positive silver transfer image. After this transfer of image-forming silver, the negative image component is separated from the positive silver transfer image — the processing composition including the silver halide developing agent being adhered to the surface of the negative component. If allowed to remain, adherence of the developing agent to the negative component after separation from the positive element will adversely affect the quality of the negative image since unoxidized developing agent will react with atmospheric oxygen to form a color product which forms stains, and oxidation products of developing agent have a tendency to oxidize silver, thereby causing the negative image to fade or lose density.

To obviate the above-mentioned problems, it has heretofore been customary to subject at least the negative image to an immediate after-treatment, e.g., a washing, in order to remove residual developing agent.

It has been discovered that this immediate washing may be delayed for extended periods of time if the surface of the developer layer can be protected from uneven oxygen exposure while the moisture is allowed to leave through a uniformly thick layer of a class of protective materials.

BRIEF SUMMARY OF THE INVENTION

This invention is directed to a process for protecting and preserving exposed, developed, fixed, but unwashed diffusion transfer type photographic negatives. More specifically, the process of this invention protects and preserves the negative component of a diffusion transfer photographic system capable of providing a usable negative (e.g., Type 55 P/N or T 105 films sold by Polaroid Corporation of Cambridge, Mass., U.S.A.) which component may be used to produce a reflection print. Diffusion transfer material of this type may be exposed, developed and fixed in a camera, or may be exposed in a camera and developed and fixed outside the camera. After development and fixing, the negative component is stripped from the positive print component. At this point, the emulsion is soft and as a result of the image-formation mechanism, a layer of processing composition adheres to the surface of the negative. This processing composition layer still has chemical activity and should be removed from the emulsion within about 3 minutes to prevent staining of the negative image. According to one embodiment of the present invention, staining of the negative image can be prevented without the necessity of an immediate removal of the processing composition layer, if very soon after separation there is applied to the surface of the negative emulsion layer a material selected from a particular class of vapor-permeable macromolecules.

With the employment of this treatment, washing can be delayed and the photographer may pursue other tasks under studio or field conditions. For the photographer working away from the studio, being able to delay washing negatives means that liquid washes and their containers need no longer be carried into the field.

With reference to the foregoing considerations, a principal object of the present invention is to provide a means for protecting and preserving a wet, developed and fixed diffusion-transfer type negative until it can be further processed.

Another object of this invention is to provide means for protecting and preserving a diffusion transfer type negative from which, after delayed processing, high quality reflection prints are easily produced by usual optical printing methods.

A further object is to provide a preserved and protected, exposed, developed and fixed diffusion transfer negative which can be further processed at the convenience of the technician.

A still further object of this invention is to provide a preserved and protected exposed, developed and fixed diffusion transfer negative which may be used after further processing to prepare high quality reflection prints by usual optical printing methods.

Other objects will in part be obvious and will in part appear hereinafter.

The invention accordingly comprises the several steps and the relation and order of one or more of such steps with respect to each of the others, and the product possessing the features, properties and the relation of elements which are exemplified in the following detailed disclosure, and the scope of the application of which will be indicated in the claims.

For a fuller understanding of the nature and objects of the invention, reference should be had to the following detailed description.

DETAILED DESCRIPTION OF THE INVENTION

According to the present invention, a photosensitive silver halide emulsion, carried on a transparent support, is developed with an aqueous alkaline processing fluid which is in superposed relationship with an image-receiving sheet. The processing composition includes a silver halide solvent which is capable of forming a water-soluble complex with unexposed and undeveloped silver halide. The resulting silver complex is transferred, by diffusion, to a superposed imagereceiving layer containing silver precipitating agents. The silver of the transferred silver complex is there precipitated to form a silver transfer positive image. After a predetermined imbibition period, the image-receiving layer containing the silver transfer image is separated from the silver halide emulsion layer, the processing composition layer being adhered to the silver halide emulsion layer. This processing composition layer is no longer uniform in thickness, since, among other things, separating the image-receiving layer from the surface of the processing composition layer introduces irregularities. Beneath this irregular processing composition layer a fully developed and fixed high quality negative is formed concurrently with the formation of a high quality transfer image. The negative image is insensitive to further exposure to light and may be handled in the light immediately upon removal from the image-receiving layer. However, if this negative is not immediately washed, beginning within 3 minutes after separation from the image-receiving layer, the pictures obtained from using this negative for printing will show mottle, an undesired irregular density gradient, as a result of stain in the negative.

It has been found that immediate washing can be delayed without harm to the negative if, subsequent to the separation of the negative component from the image-receiving layer, before the changes occur which lead to the stain, e.g., about 3 minutes from separation, the surface of the processing layer is contacted with a member of a given class of protective materials in such a way as to allow uniform vapor transfer out of the negative.

Ways of contacting the surface of the processing layer with one of the protective materials include swabbing on a solution of the desired protective material; spraying solution of the protective material; applying the material in particulate form or applying a supported preformed film of the protective material directly to the negative, under pressure.

In the swabbing method, an absorbant material which is capable of retaining a quantity of liquid composition is wetted with, for example, alcohol, and then placed in a 10% w/w alcoholic solution of the protective material for approximately half an hour to absorb the solution. Excess solution is allowed to drain away and a wet swab is used to wipe off the reagent layer from the surface of the exposed, developed and fixed emulsion layer. A second swab is then used to go over the surface of the emulsion to ensure that a uniform layer of the protective material is left on the emulsion. The treated negative is allowed to dry, 20 to 30 minutes at room temperature usually being sufficient time. The negative so treated may then be put aside for later further processing in the conventional manner. Protective materials which may be used in this method are colloids and include, for example, hydroxypropyl cellulose, poly-2-N-vinyl pyridine lactate, etc.

If particulate material is used, within 3 minutes after the exposed, developed and fixed negative has been separated from an image-receiving sheet in a typical diffusion transfer process the emulsion surface with the adhered processing composition layer is inverted over a supply of the dry protective material of a particular size (e.g., as sieved through a 325 mesh screen). The negative is held over the particulate material and lightly shaken to spread the powder evenly over the surface of the adhered processing composition layer without forming lumps which would lead to uneven drying. The negative is then allowed to dry. Examples of protective materials which may be used in this manner include, for example, xanthan gum, guar gum, anionic polysaccharide gum, high molecular weight hetero-polysaccharide gum, methyl cellulose, hydroxyethyl cellulose, sodium carboxymethyl cellulose, polyvinyl alcohol, hydroxypropyl cellulose, etc.

In the cast-film method a 10% solution by weight of a colloidal film-forming material in water is coated on a suitable base, such as a semi-glassine type paper in a 1.25 mil thickness made of a supercalendered stock, to a thickness of from 0.1 to 0.5 mil, and allowed to dry. The polymer-coated side of this supported cast-film is placed in contact with the reagent layer remaining on the surface of a freshly stripped exposed, developed and fixed negative within 3 minutes after its separation from the positive element. It is necessary to achieve continuous contact between the surface of the processing composition layer and the cast film, to assure that no air bubbles are trapped. This may be accomplished, for example, by gently rolling a thin, smooth cylindrical object, such as a pencil, over the structure which is supported on any smooth film surface. This cast-film coating protects and preserves the negative until processing is continued.

Examples of colloidal film-forming materials which may be used in this cast film approach are, for example, methyl cellulose, hydroxyethyl cellulose, sodium carboxymethyl cellulose, polyvinyl alcohol, polyacrylamide, polyvinyl pyrrolidone, polyvinyl acetate, etc.

The following non-limiting examples illustrate the present invention.

EXAMPLE 1

Hydroxyethyl cellulose (Natrosol 250L manufactured by Hercules, Inc.) was dissolved in water to form a water solution by weight according to the directions of the manufacturer. This solution was coated to a 0.3 mil thickness on a supercalendered, semi-glassine paper base and allowed to dry. A 4 by 5 inch sheet of this supported cast film was placed on the surface of a freshly stripped (55 P/N) negative and was rolled gently to remove any air trapped between the two sheets. This packet was then allowed to dry for 4 hours. At the end of that time, it was placed in an 18% sodium sulfite bath for approximately 5 minutes, whereupon the cast film and processing composition layer separated from the negative. The negative was placed in an acid hardening bath comprising acetic acid and potassium alum for approximately 2 minutes, rinsed in running water for 10 minutes, then in 0.01% isooctyl phenyl polyethoxyethanol (Triton-X-100, supplied by Rohm and Haas Co.) wetting agent, and allowed to dry. The dried negative was then used to print a five-fold enlargement which was examined for mottle. That enlargement was compared to an enlargement printed from a 55 P/N negative which had been completely processed, including a sodium sulfite wash, within 3 minutes after its separation from the positive image-receiving sheet. The picture printed from the negative treated according to the process of this invention was as clear and free from mottle as the picture printed from the immediately washed negative.

EXAMPLE 2

A 10% w/w aqueous solution of methyl cellulose was coated to a 0.3 mil thickness on a supercalendered, semi-glassine paper base and allowed to dry. A 4 by 5 inch sheet of this supported cast film was placed film side down to the surface of a freshly stripped 55 P/N negative; compressive force was applied gently to expel air from between the cast film and the negative, and the packet was allowed to dry for 4 hours. It was then washed for 5 minutes in an 18% sodium sulfite bath where the paper, cast film and negative separated from the negative. This negative was placed in an alum-acetic acid bath for hardening, then washed with running water, dipped into Triton-X-100 wetting agent and allowed to dry. The dry negative was used to print a positive print which was examined for mottle. It was compared with a control print as described in Example 1 and was found to have no visibly discernible mottle.

EXAMPLES 3-7

Ten percent aqueous solution of the following materials were used to prepare cast films as in Example 2.

| Example | Film Forming Material |
|---|---|
| 3 | sodium carboxymethyl cellulose |
| 4 | polyvinyl alcohol |
| 5 | polyacrylamide |
| 6 | polyvinyl pyrrolidone |
| 7 | polyvinyl acetate |

These cast films were used as in Example 2 to protect and preserve freshly stripped 55 P/N diffusion transfer negatives. Positive prints made from these negatives were examined for mottle and none was visually detected.

EXAMPLE 8

Swabs of a soft, absorbant, nonwoven, cotton material in strip form (supplied as Webril by Kendall Mills) arranged in an assembly of layers and provided with a handle were wetted with isopropyl alcohol, then placed in a 10% by weight isopropyl alcohol solution of hydroxypropyl cellulose for half an hour. Excess solution was allowed to drain. One swab was used to wipe the processing composition from the surface of a freshly stripped exposed, developed and fixed diffusion transfer negative. A second swab was then wiped over the emulsion surface to ensure uniformity of the layer of hydroxypropyl cellulose left thereon. The two wiping operations were completed within 3 minutes after the image-receiving layer was stripped for the emulsion layer. The treated negative was allowed to dry 30 minutes at room temperature and then washed with the conventional materials for washing the untreated negatives using wash times of 5 minutes for the 18% sodium sulfite aqueous solution, 2 minutes for the acid alum hardening wash, and 10 minutes for the running water wash. After a final dip in 0.01% Triton-X-100 wetting agent, the treated negative was allowed to dry. The dried negative was used to print a five-fold enlargement which was examined for mottle. As compared to the picture printed from an immediately washed, conventionally treated negative as described in Example 1, there was no visibly discernible mottle.

EXAMPLE 9

Example 8 was repeated replacing the hydroxypropyl cellulose with poly-2-N-vinyl pyridine lactate, and essentially the same results were obtained.

EXAMPLE 10

The negative components of 20 units of positive-negative 55 P/N film material were exposed to a step wedge target, developed and fixed in the conventional way. Four of these negatives were processed in the conventional way, which included an immediate sodium sulfite wash, acid hardening wash, water wash, wetting agent and drying as described in the preceding examples. Within 3 minutes after stripping, the other 16 negatives were inverted on an opening in a container containing guar gum, fine powder sieved through a 325 mesh screen and dusted by inverting and shaking. The dusted negatives were put aside for varying periods of time, four for 1 hour, four for 4 hours, four for 24 hours and four for 96 hours. At the end of these times the negatives were each washed in, successively, 18% sodium sulfite, alum-acetic acid hardening bath, running water and 0.01% of Triton-X-100 agent. After drying, each of the 20 negatives was used to prepare a five-fold enlarged positive print. Not one of the negatives treated according to the process of this invention showed a visibly discernible pattern at this five-fold enlargement as compared with the standard, conventionally treated, immediately washed control negative described above.

EXAMPLES 11-13

The procedure of Example 10 was employed to treat freshly stripped 55 P/N negatives using in place of guar gum the following materials:

11. An "anionic polysaccharide gum" supplied as GPC Colloid RX-10 by Grain Processing Corp.

12. A "high molecular weight hetero-polysaccharaide gum" supplied as Zanflo by Kelco Co.

13. Xanthan gum supplied as Kelzan by Kelco Co.

Essentially the same results were obtained as in Example 10.

Since certain changes may be made in the above process without departing from the scope of the invention herein involved, it is intended that all matter contained in the above description shall be interpreted as illustrative and not in a limiting sense.

What is claimed is:

1. In a process for forming a diffusion transfer negative element capable of being employed to provide reflection images which comprises:

a. exposing a diffusion transfer photosensitive element comprising a silver halide layer to actinic radiation;

b. providing a layer of processing composition including a developing agent whose adherence to said negative element after the development and fixing of said negative element would adversely affect the quality of the negative image, a silver halide solvent, and a film-forming polymer between said exposed diffusion transfer photosensitive element and a diffusion transfer silver receptive stratum in face-to-face relationship therewith;

c. developing said exposed diffusion transfer photosensitive element to provide a negative image and forming a positive image thereof in said silver receptive stratum by silver diffusion transfer as a function of point-to-point degree of exposure of said photosensitive element;

d. separating said silver receptive stratum from said negative image which has said layer of processing composition adhered thereto;

e. washing said developed negative image with aqueous sodium sulfite, and f. washing said negative with water, the improvement which comprises applying to the surface of said layer of processing composition while said surface remains moist and before washing with aqueous sodium sulfite a uniform layer of a vapor-permeable polymeric macromolecule whereby washing of said negative image may be delayed for an extended period without injury to it.

2. A process as defined in claim 1 wherein the uniform layer of a vapor-permeable macromolecule is in the form of a cast film adhered to the surface of the negative image.

3. A process as defined in claim 2 where said vapor-permeable macromolecule is selected from a group consisting of cellulose ethers and vinyl polymers.

4. A process as defined in claim 2 wherein said vapor-permeable macromolecule is hydroxyethyl cellulose.

5. A process as defined in claim 1 wherein said vapor-permeable macromolecule is methyl cellulose applied to the surface of said layer of processing composition in the form of a powder which has been sieved through a screen at least as fine as 325 mesh.

6. In a process for forming a diffusion transfer negative element capable of being employed to provide positive reflection images which comprises:

a. exposing a diffusion transfer photosensitive element comprising a silver halide layer to actinic radiation;

b. providing a layer of processing composition including a developing agent whose adherence to said negative element after the development and fixing of said negative element would adversely affect the quality of the negative image, a silver halide solvent, and a film-forming polymer between said exposed diffusion transfer photosensitive element and a diffusion transfer silver receptive stratum in face-to-face relationship therewith;

c. developing said exposed diffusion transfer photosensitive element to provide a negative image and forming a positive image thereof in said silver receptive stratum by silver diffusion transfer as a function of point-to-point degree of exposure of said photosensitive element;

d. separating said silver receptive stratum from said negative image which has said layer of processing composition adhered thereto;

e. washing said developed negative with aqueous sodium sulfite; and f. washing said negative with water, the improvement which comprises removing said processing composition layer while still moist and before washing with aqueous sodium sulfite by swabbing said negative image with a solution of a vapor-permeable polymeric macromolecule; and applying to the surface of said developed negative image while said surface is still moist a uniform layer of said vapor-permeable macromolecule whereby washing of said negative image may be delayed for an extended period without injury to it.

7. A process as defined in claim 6 wherein said vapor-permeable macromolecule is selected from the group consisting of cellulose ethers and vinyl polymers.

8. A process as defined in claim 6 wherein said vapor-permeable macromolecule is hydroxypropyl cellulose.

* * * * *